US005483018A

United States Patent [19]

Aoki et al.

[11] Patent Number: 5,483,018

[45] Date of Patent: Jan. 9, 1996

[54] AUTOMATIC ARRANGEMENT APPARATUS INCLUDING SELECTED BACKING PART PRODUCTION

[75] Inventors: Eiichiro Aoki, Hamamatsu; Kazunori Maruyama, Tokyo, both of Japan

[73] Assignee: Yamaha Corporation, Japan

[21] Appl. No.: 215,788

[22] Filed: Mar. 22, 1994

[30] Foreign Application Priority Data

Mar. 23, 1993 [JP] Japan ..... 5-064341

[51] Int. Cl.[6] ..... G10H 1/38; G10H 1/42; G10H 1/46

[52] U.S. Cl. ..... 84/611; 84/613; 84/633; 84/DIG. 12; 84/DIG. 22

[58] Field of Search ..... 84/609–614, 626–638, 84/649–652, 662–669, 701–717, DIG. 12, DIG. 22

[56] References Cited

U.S. PATENT DOCUMENTS 4,966,051 10/1990 Tajima ..... 84/663

*Primary Examiner*—Stanley J. Witkowski
*Attorney, Agent, or Firm*—Parkhurst, Wendel & Rossi

[57] ABSTRACT

An automatic arrangement apparatus for automatically producing performance data indicative of a predetermined performance part of a musical tune on a basis of an arrangement condition intended to be arranged. The arrangement apparatus includes a baeklng type table memory for memorizing rhythm backing and non-rhythm backing in compliance with a predetermined combination of a performance style, loudness of musical tones and a performance feeling or mood such as melodic or rhythmic feeling. Based on the arrangement condition applied from an external equipment such as an electronic musical instrument or an external recorder by operation of an Input device, either the rhythm backing or the non-rhythm backing is selected to produce a backing part at a timing of a rhythm pattern memorized in a rhythm pattern memory or at a timing of variation of chords memorized in a chord progression memory.

8 Claims, 8 Drawing Sheets

Fig. 2

BACKING TYPE TABLE

| | | | |
|---|---|---|---|
| JAZZ | P P or P | MELODIC | NON-RHYTHM BACKING |
| | | RHYTHM | NON-RHYTHM BACKING |
| | mf | MELODIC | NON-RHYTHM BACKING |
| | | RHYTHM | RHYTHM BACKING |
| | f or f f | MELODIC | RHYTHM BACKING |
| | | RHYTHM | RHYTHM BACKING |
| 8 beat | P P or P | MELODIC | NON-RHYTHM BACKING |
| | | RHYTHM | RHYTHM BACKING |
| | mf | MELODIC | NON-RHYTHM BACKING |
| | | RHYTHM | RHYTHM BACKING |
| | f or f f | MELODIC | RHYTHM BACKING |
| | | RHYTHM | RHYTHM BACKING |
| ⋮ | ⋮ | ⋮ | ⋮ |

CHORD PROGRESSION MEMORY

RHYTHM PATTERN MEMORY

AUTOMATIC ARRANGEMENT APPARATUS INCLUDING SELECTED BACKING PART PRODUCTION

BACKGROUND OF THE INVENTION

1. Field of the Invention

The present invention relates to an automatic arrangement apparatus for automatically producing performance data indicative of a desired performance part of a musical tune on a basis of an arrangement condition intended to be arranged by a user.

2. Description of the Prior Art

In recent years, there has been proposed an automatic arrangement apparatus for producing performance data indicative of a predetermined performance part based on a melody and chord progression. On the other hand, there has been provided an automatic accompaniment apparatus wherein bass performance and chord backing performance are played in response to melody performance played on the right-hand key area and chord performance played on the left-hand key area. The automatic accompaniment apparatus of this kind is deemed to be a kind of automatic arrangement apparatus in a broad meaning.

In the automatic arrangement apparatus in a narrow meaning, a melody and chord progression are preliminary applied to produce performance data of a bass part and a backing part. It is, therefore, considered that there is a room for conducting high grade musical processing in consideration with development based on the melody and chord progression. The arrangement effected in the conventional automatic accompaniment apparatus or arrangement apparatus is, however unsatisfactory when compared with an arrangement made by a musician.

SUMMARY OF THE INVENTION

It is, therefore, a primary object of the present invention to provide an automatic arrangement apparatus wherein an arrangement condition applied thereto is utilized in maximum by permitting a technologically ambiguous content for the arrangement condition, and wherein a plurality of arrangement methods are adapted in various manners to effect automatic arrangements in a higher musical sense in contrast with the conventional arrangement.

According to the present invention, the object is accomplished by providing an automatic arrangement apparatus which comprises first input means for applying performance data of a basic performance part for arrangement to a musical tune to be arranged; second input means for applying an arrangement condition indicative of a desired performance for arrangement to the musical tune; first performance data production means for producing a first performance data with an algorithm suitable for expression of a desired rhythmic feeling; second performance data production means for producing a second performance data with an algorithm suitable for expression of a non-rhythmic feeling different from the rhythmic feeling; selection means for selecting either the first or second performance data in accordance with the arrangement condition; and means for automatically producing performance data indicative of a performance part defined by the selected performance data.

According to an aspect of the present invention, there is provided an automatic arrangement apparatus wherein the second input means is arranged to apply an arrangement condition related to amplification of a rhythm to the musical tune, the first performance data production means is arranged to produce a first performance data suitable for effecting amplification of the rhythm, and the second performance data production means is arranged to produce a second performance data suitable for making amplification of the rhythm ineffective.

According to another aspect of the present invention, there is provided an automatic arrangement apparatus wherein the second input means is arranged to apply an arrangement condition related to loudness of the desired performance to the musical tune, the first performance production means is arranged to produce a first performance data suitable for amplifying a rhythm, and the second performance data production means is arranged to produce a second performance data suitable for making amplification of the rhythm ineffective.

According to a further aspect of the present invention, there is provided an automatic arrangement apparatus wherein the second input means is arranged to apply an arrangement condition related to amplification of a rhythm and loudness of the desired performance to the musical tune, the first performance data production means is arranged to produce a first performance data suitable for effecting amplification of the rhythm, and the second performance data production means is arranged to produce a second performance data suitable for making amplification of the rhythm ineffective.

According to a still further aspect of the present invention, there is provided an automatic arrangement apparatus wherein the second input means is arranged to apply an arrangement condition related to loudness of the desired performance and a performance style to the musical tune, the first performance data production means is arranged to produce a first performance data suitable for effecting amplification of the rhythm, and the second performance data production means is arranged to produce a second performance data suitable for making amplification of the rhythm ineffective.

BRIEF DESCRIPTION OF THE DRAWINGS

Further objects, features and advantages of the present invention will be readily appreciated from the following detailed description of a preferred embodiment thereof when considered with reference to the accompanying drawings, in which:

FIG. 2 illustrates a backing type table stored in a backing type table memory shown in FIG. 1;

DESCRIPTION OF THE PREFERRED EMBODIMENT

Figure 1:
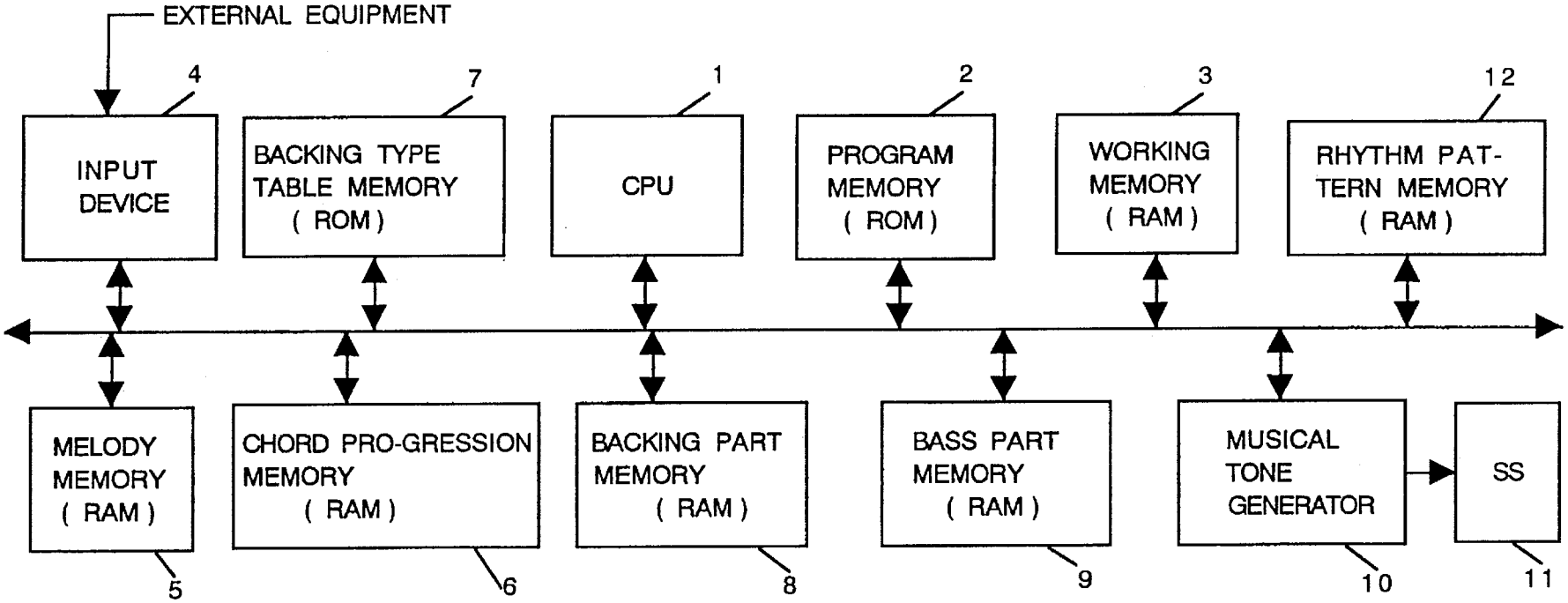
FIG. 1 is a block diagram of an automatic arrangement apparatus in accordance with the present invention.

In FIG. 1 of the drawings, there is schematically illustrated a block diagram of an automatic arrangement apparatus in accordance with the present invention. The automatic arrangement apparatus includes a central processing unit or CPU 1 which is designed to use a working area of a working memory 3 for executing a control program stored in a program memory 2 in the form of a read-only memory or ROM thereby to arrange a backing part and a bass part based on melody data and chord progression data applied thereto at an automatic arrangement mode for conducting automatic performance at an automatic performance mode defined by the arrangement of the backing and bass parts. That is to say, the automatic arrangement and performance modes are designated by manipulation of an input device 4. At the automatic arrangement mode, the CPU 1 is applied with the melody data and chord progression data from an external equipment such as an electronic musical instrument or an external recorder through the input device 4 to temporarily memorize the melody data and chord progression data respectively in a melody memory 5 and a chord progression memory 6 each in the form of a random-access memory or RAM. Subsequently, the CPU 1 refers to a backing type table memory 7 in the form of a read-only memory or ROM on a basis of an arrangement condition selected by manipulation of the input device 4 for determining the type of backing to either non-rhythm backing or rhythm backing.

Thus, the CPU 1 produces a backing part corresponding to the memorized melody data and chord progression data and the type of backing In accordance with the arrangement condition selected by manipulation of the input device 4 and memorizes the backing data in a backing part memory 8. The CPU i converts in tone pitch a preliminary memorized pattern data on a basis of the chord progression data to produce a bass part and memorizes performance data indicative the produced bass part in a bass part memory 9. When the rhythm backing has been determined, the CPU 1 produces a backing part based on a rhythm pattern memorized in a rhythm pattern memory 12.

At the automatic performance mode, the CPU 1 applies the melody data, chord progression data and the performance data indicative of the memorized backing and bass parts to a musical tone generator 10 and causes the musical tone generator to produce musical tone signals therefrom for generating a musical sound at a sound system 11. As shown in FIG. 2, the backing type table stored in the ROM 7 is designed to memorize non-rhythm backing and rhythm backing which correspond with a predetermined combination of a performance style such as Jazz or 8-beat, loudness of musical tones such as pianissimo, mezzo forte or forte and a musical feeling such as melodic or rhythmic feeling or mood. When applied with the performance style, loudness of musical tones and musical feeling as an arrangement condition by manipulation of the input device 4, the CPU 1 refers to the backing type table to determine the type of backing to the non-rhythm backing or the rhythm backing in accordance with the arrangement condition.

Figure 3:
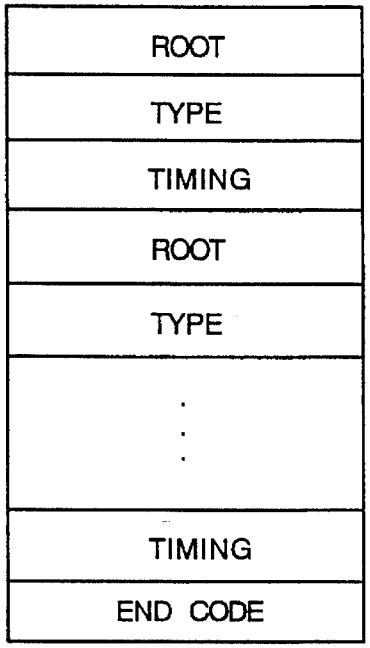
FIG. 3 illustrates a chord progression format memorized in a chord progression memory shown in FIG. 1.
Figure 4:
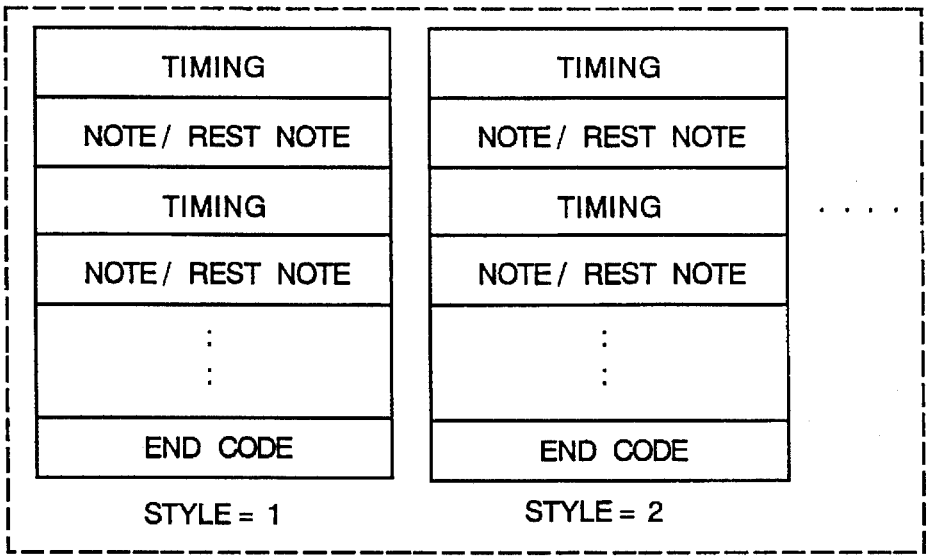
FIG. 4 illustrates a rhythm pattern format memorized in a rhythm pattern memory shown in FIG. 1.

Although in FIG. 2 the table content for "jazz" is shown in detail, it may be modified in accordance with an arrangement method actually conducted by the user for the performance style. As shown In FIG. 3, the chord progression memory 6 is designed to memorize a plurality of codes for the root and the type of chord and to memorize each start timing of the chords except for the first chord. Assuming that the non-rhythm backing has been determined, the start timing of the following chord is adapted as a key-off taming of the preceding chord. In addition, the start timing of the first chord is set as "0". As shown in FIG. 4, the rhythm pattern memory 12 is designed to memorize a plurality of rhythm pattern data each of which corresponds with the performance style. The rhythm pattern data each includes plural pairs of a timing data and a note or rest note for one measure and an end code indicative of termination of the measure. The timing data represents a timing for generation or disappearance of a musical tone in the one measure. In this embodiment, the note code is adapted to represent generation of the musical tone, and the rest note code is adapted to represent disappearance of the musical tone. The timing and interval of the notes in the melody data, chord progression data or the rhythm patterns are defined by a predetermined clock value which is used as a unit of the timing data to correspond, for instance. a quarter note with twenty four (24) clocks.

Figure 5:
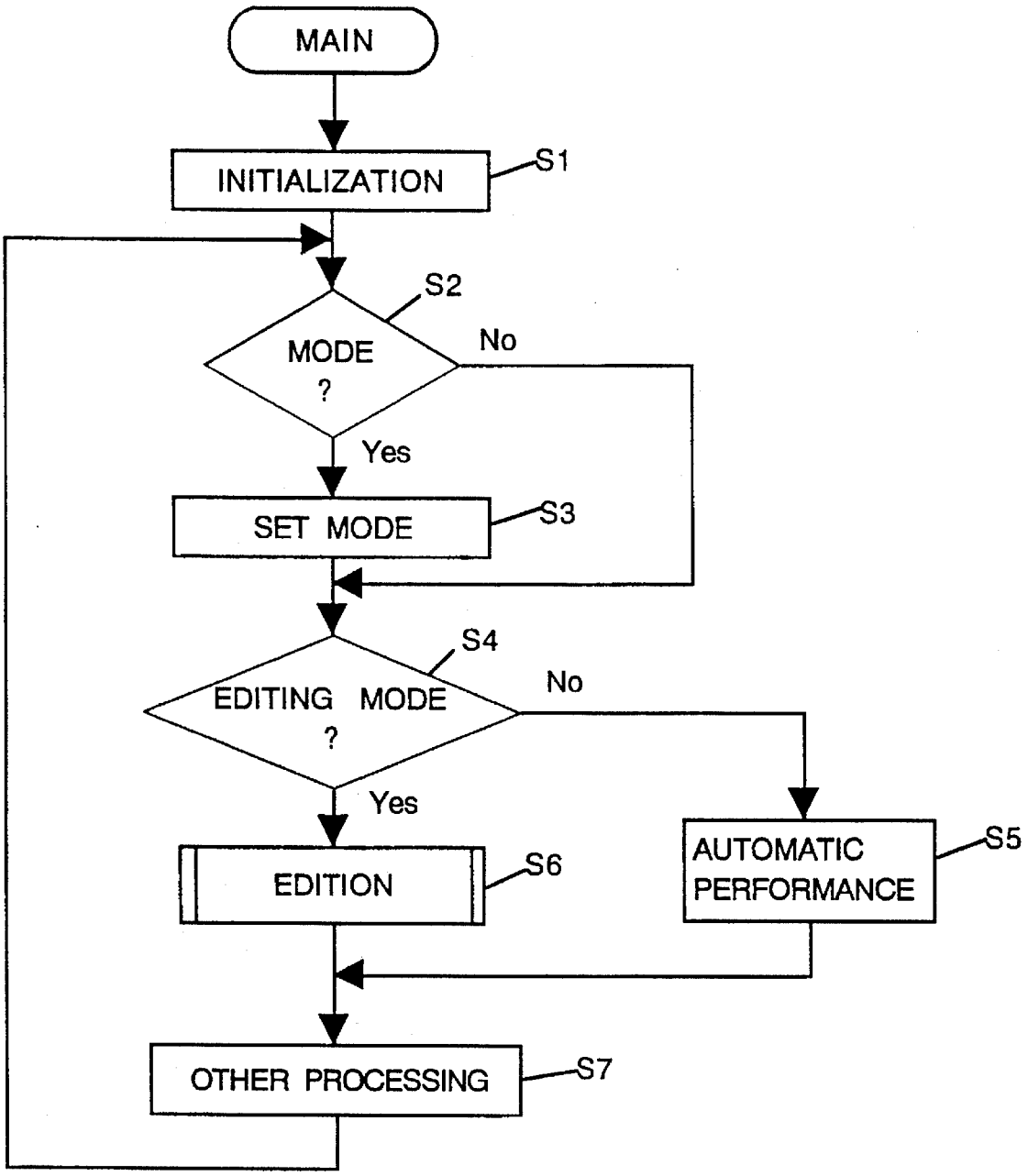
FIG. 5 is a flow chart of a main routine of a control program executed by a central processing unit shown in FIG. 1.

A flow chart of a main routine of the control program is illustrated in FIG. 5, and flow charts of sub-routines of the control program are illustrated in FIGS. 6 to 10. Hereinafter, operation of the automatic arrangement apparatus will be described with reference to these flow charts. In the following description, respective registers and pointers of the chord progression memory and backing part memory, key-codes and pitch names of composite tones of the chord are represented as listed below.

CHD(i): Data of the number (i) in the chord progression memory

CC(i): Predetermined key-codes of three composite tones of the chord in the chord progression NT(i): Predetermined pitch names of the three composite tones of the chord in the chord progression BPM(i): Data of the number (i) in the backing part memory CP: Pointer of the chord progression memory BP: Pointer of the backing part memory.

When connected to an electric power source, the CPU 1 is activated to initiate processing of the main routine shown in FIG. 5. At step S1, the CPU 1 initializes variables to be used in the following processing and determines at step S2 whether or not the input device 4 has been operated to switch over a performance mode. If the answer at step S2 is "Yes", the program proceeds to step S3 where the CPU 1 sets a mode flag as a normal mode or an editing mode and causes the program to proceed to step S4. If the answer at step S2 is "No", the program proceeds to step S4 where the CPU 1 determines whether the mode flag is set as the editing mode or not. If the answer at step S4 is "No", the program proceeds to step S5 where the CPU 1 executes processing for automatic performance data to be applied to the musical tone generator 10 and causes the program to proceed to step S7 for other processing. If the answer at step S4 is "Yes", the program proceeds to step S6 where the CPU 1 executes processing of an editing routine shown in FIG. 6 and causes the program to proceed to step S7 for the other processing. After executed the other processing at step S7, the CPU 1 returns the program to step S2.

Figure 6:
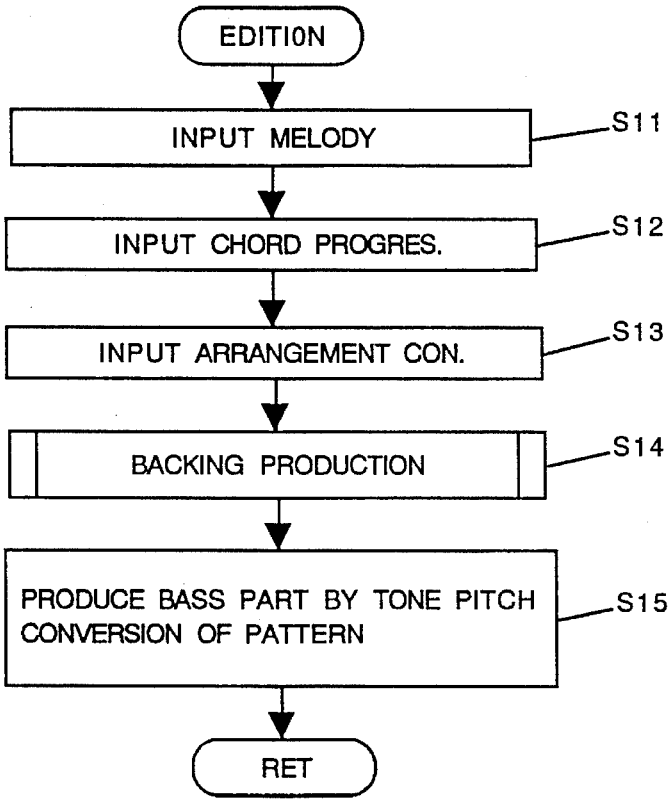
FIG. 6 is a flow chart of an editing routine of the control program.

During execution of the editing routine shown in FIG. 6, the CPU 1 is applied with melody data from the external equipment through the input device 4 at step S11 and memorizes the melody data in the melody memory 5. In this instance, the melody data includes tone pitch data of a melody. data for generation or disappearance of a musical tone and a timing data for generation or disappearance of The musical tone. Subsequently, the CPU 1 is applied with chord progression data from the external equipment through The input device 4 at step S12 and memorizes the chord progression data in the chord progression memory 6. The chord progression data includes chord data composed of the root and the type of a chord and time interval data for allotment of the chord data aligned in sequence. At the following step S3, the CPU 1 is applied with an arrangement condition by manipulation of the input device 4 for execution of a backing production routine shown in FIG. 7. The arrangement condition is defined to represent a performance style such as "Jazz", "8-beat" or the like, a loudness of musical tones such as "pianissimo PP", "piano P", "mezzo forte mr", "forte f", "fortesslmo ff" or the like, a feeling or mood of the musical tune represented by "melodic" or "rhythmic". When completed the processing of the backing production routine, the CPU 1 produces a bass part at step S15 and returns the program to the main routine. For production of the bass part, the CPU 1 converts in tone pitch the pattern of a preliminary memorized bass part including data for generation or disappearance of a bass tone, a timing of the tone generating, a key-code of the bass tone and the like on a basis of the chord progression information taking into consideration with a standard data such as C Major and memorizes the converted pattern of the bass part in the bass part memory 9.

Figure 7:
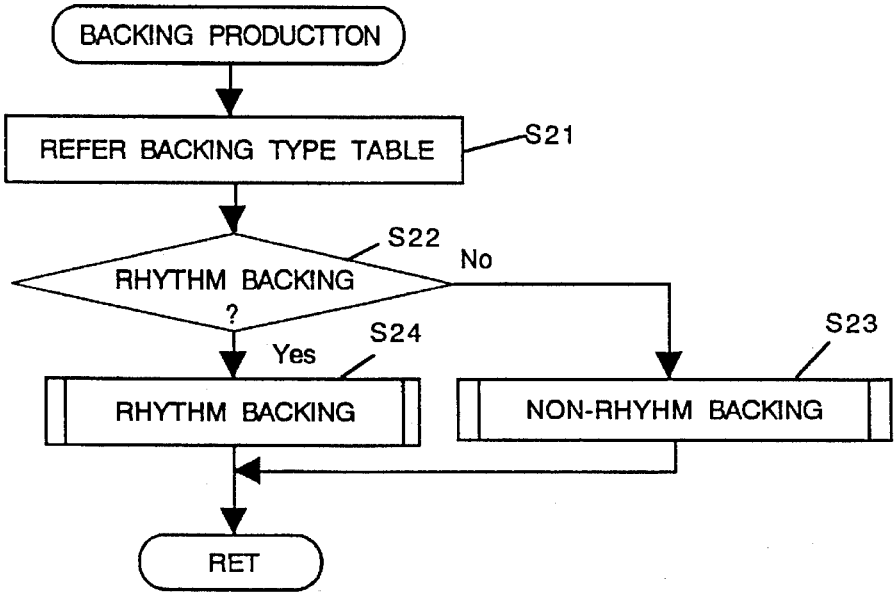
FIG. 7 is a flow chart of a backing production routine of the control program.

During execution of the backing production routine shown in FIG. 7, the CPU I refers to the backing type table of FIG. 2 based on the arrangement condition at step S21 For determining the type of backing to either the rhythm backing or the non-rhythm backing. At the following step S22, the CPU 1 determines whether the rhythm backing has been determined or not. If the answer at step S22 is "No", the program proceeds to step S23 where the CPU 1 executes a non-rhythm backing routine shown in FIGS. 8 and 9 and returns the program to the editing routine. If the answer at step S22 is "Yes", the program proceeds to step S24 where the CPU 1 executes a rhythm backing routine shown in FIG. 10 and returns the program to the editing routine.

Figure 8:
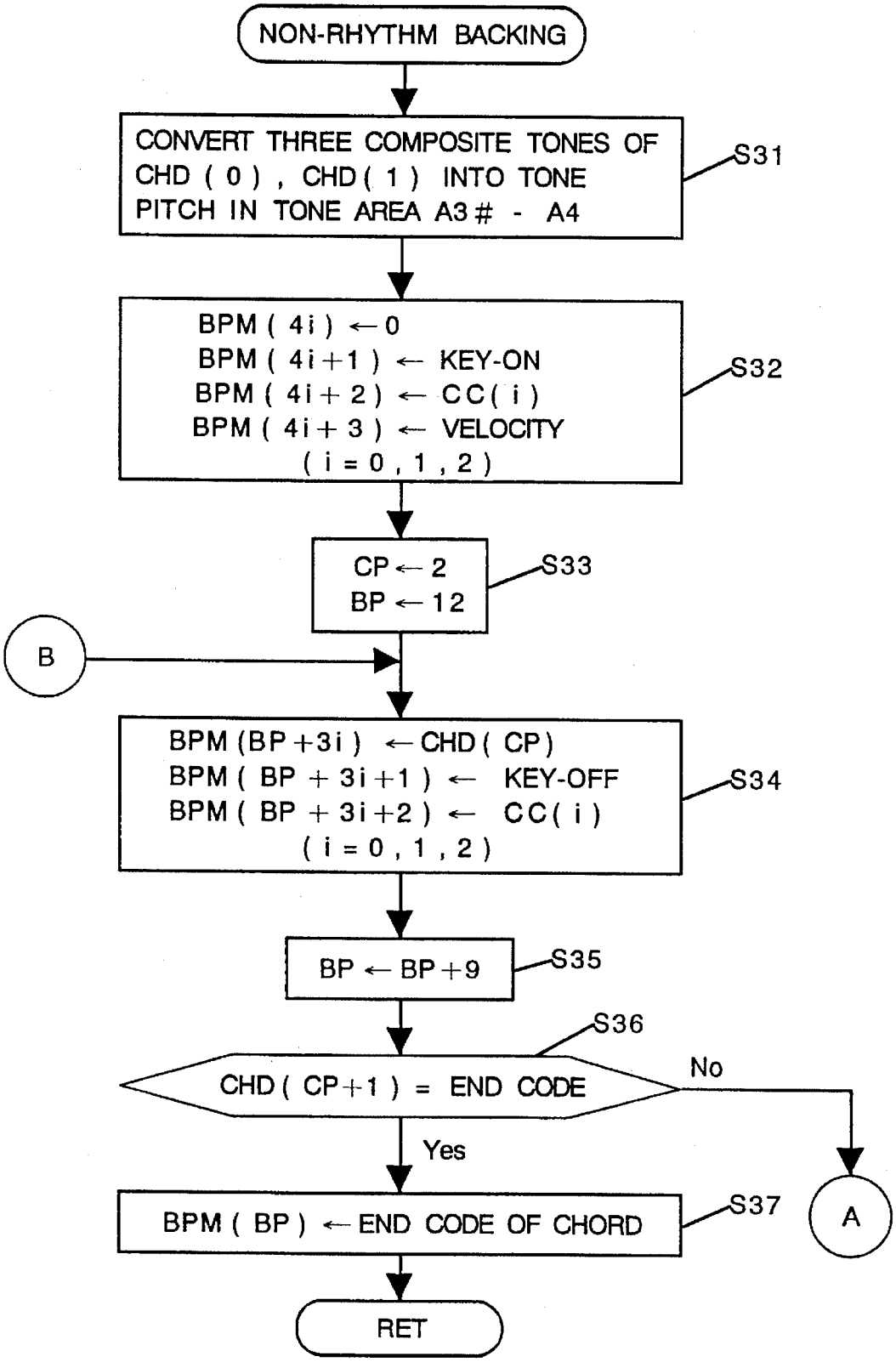
FIG. 8 is a flow chart of the front part of a nonrhythm backing routine of the control program.

During execution of the non-rhythm backing routine shown in FIG. 8, the CPU 1 converts at step S31 three composite tones of a chord identified by the chord root data CHD(0) and the chord type data CHD(1) into a key-code indicative of a tone pitch in a tone area A3#–A4 and memorizes the converted three tones in predetermined key-codes CC(0)–CC(3)in ascending sequence. At the following step S32, the CPU 1 sets data BPM(4i), BPM(4i+ 1), BPM(4i+ 2) and BPM(41+ 3) of the backing part memory 8 respectively as "0", a key-on data, a key-code CC(i) and a "velocity data" indicative of the loudness of the arrangement condition, respectively in regard to i= 0, 1, 2 and causes the program to proceed to step S33. In this instance, the chord root data, the chord type data and the time interval data are memorized In the backing part memory 8, in sequence.

At step 33, the CPU 1 sets the pointer CP of chord progression memory 6 as "2" for referring to the time interval data to the second chord data in the chord progression memory 6 and sets the pointer BP of backing part memory 8 as "12" for writing a key-off data on the terminal end of data stored in the backing part memory 8. When the program proceeds to step S34, the CPU i memorizes data BPM(BP+ 3i), BPM(BP+ 3i+ 1), BPM(BP+ 3i+ 2) of the backing part memory 8 respectively as the time interval data CttD(CP), the key-off data and the key-code data CC(i), respectively in regard to i = 0, 1, 2 and causes the program to proceed to step 35. Thus, a backing part data related to the first chord data is written in the backing part memory 8 in such a manner that the first chord data becomes key-off at the leading end of the second chord.

Subsequently, the CPU 1 adds "9" to the pointer BP at step S35 for writing the following data of the backing part after key-off of the first chord data and determines at step S36 whether the time interval data CHD(CP+ 1) become an end code or not. If the answer at step S36 is "Yes", the CPU 1 writes an end code of the first chord data on the data BPM(BP) of the backing part memory 8 at step S37 and returns the program to the backing production routine. If the musical tune is in the course of arrangement, the CPU 1 determines a "No" answer at step S36 to execute processing at step S38 to S305 shown in FIG. 9 and returns the program to step S34.

Figure 9:
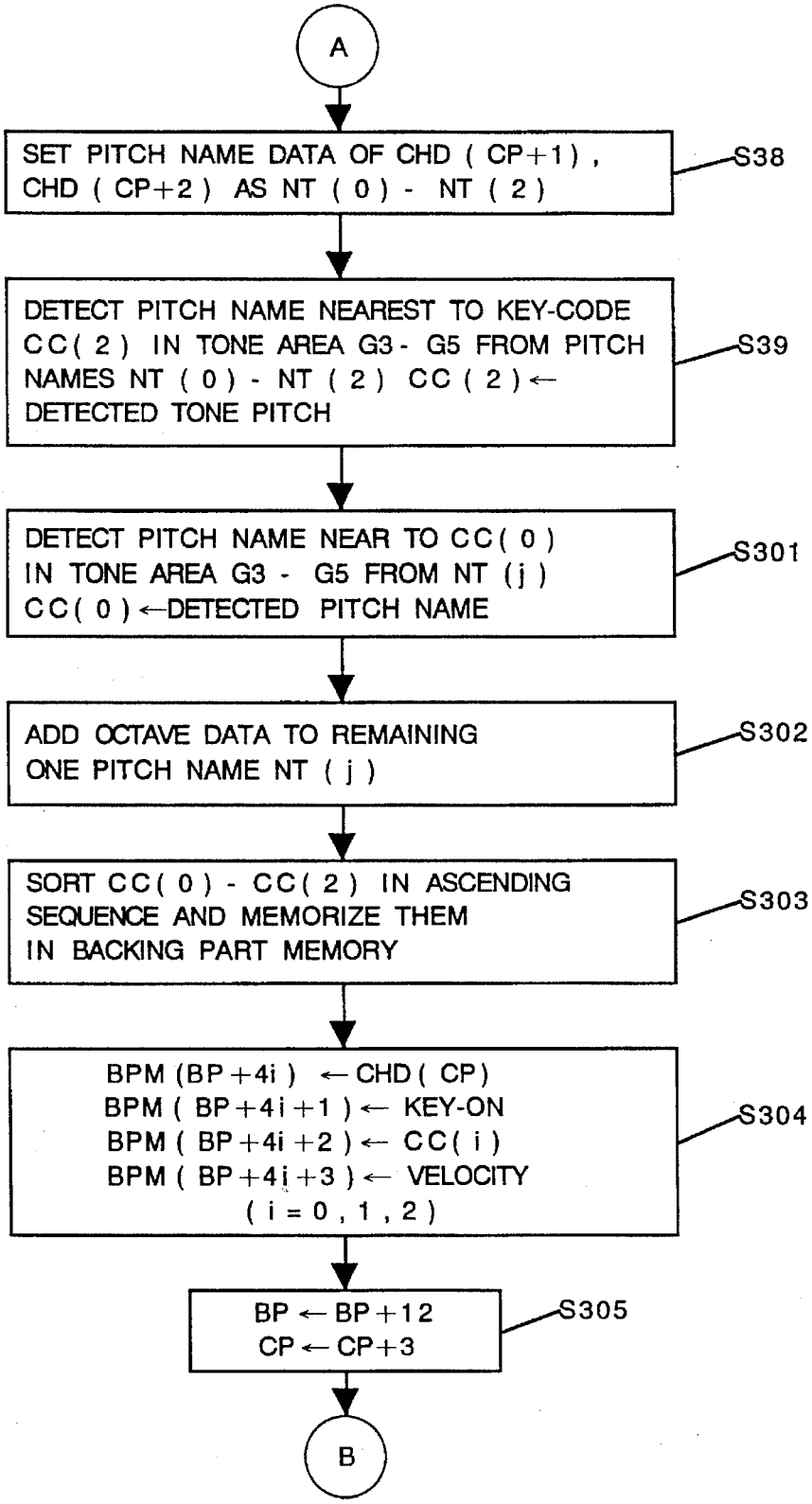
FIG. 9 is a flow chart of the back part of the nonrhythm backing routine.

At step S38 shown in FIG. 9, the CPU I sets the pitch name data of the three composite tones of the chord identified by the chord root data CHD(CP+ 1) and the chord type data CHD(CP+ 2) of the chord progression memory 6 as pitch names NT(0)–NT(2). At the following step S39, the CPU 1 detects a pitch name nearest to a key-code CC(2) in the tone area G3–G5 from the pitch names NT(0)–NT(2) and converts the detected pitch name into a key-code to memorize the converted key-code as the key-code CC(2). In this instance, the key-code CC(2) corresponds with a highest tone of three tones of the immediately past backing part. Subsequently, the CPU I detects at step S301 a pitch name near to a key-code CC(0) in the tone area G3–G5 from the remaining pitch names NT(J) and converts the detected pitch name into a key-code to memorize the converted key-code as the key-code CC(0). At the following step S302, the CPU 1 adds an octave data to the remaining one pitch name NT(j) to obtain a key-code nearest to a key-code CC(1) in the tone area G3–G5 and memorizes the key-code as the key-code CC(1). Thus, the CPU i sorts the key-codes CC(0)–CC(2) in ascending sequence and memorizes them in the backing part memory 8 to produce key-codes of the backing part.

When the program proceeds to step S304, the CPU 1 sets the produced key-codes as the backing part data into the backing part memory 8. That is to say, the CPU i memorizes the data BPM(BP+ 41), BPM(BP+ 41+ 1), BPM(BP+ 4i+ 2) and BPM(BP+ 41+ 3) of the backing part memory 6 respectively as the time interval data CHD(CP), the key-on data, the key-code CC(t) and the velocity data indicative of the performance loudness of the arrangement condition, respectively in regard to 1 = 0, 1, 2. When the program proceeds to step S305, the CPU I adds "12" to the pointer BP for writing a key-off data into the backing part memory 8 and adds "3" to the pointer CP for referring to the following data of the chord progression memory 5. Thereafter, the CPU I returns the program to step S34 of the non-rhythm backing routine shown in FIG. 8.

Figure 10:
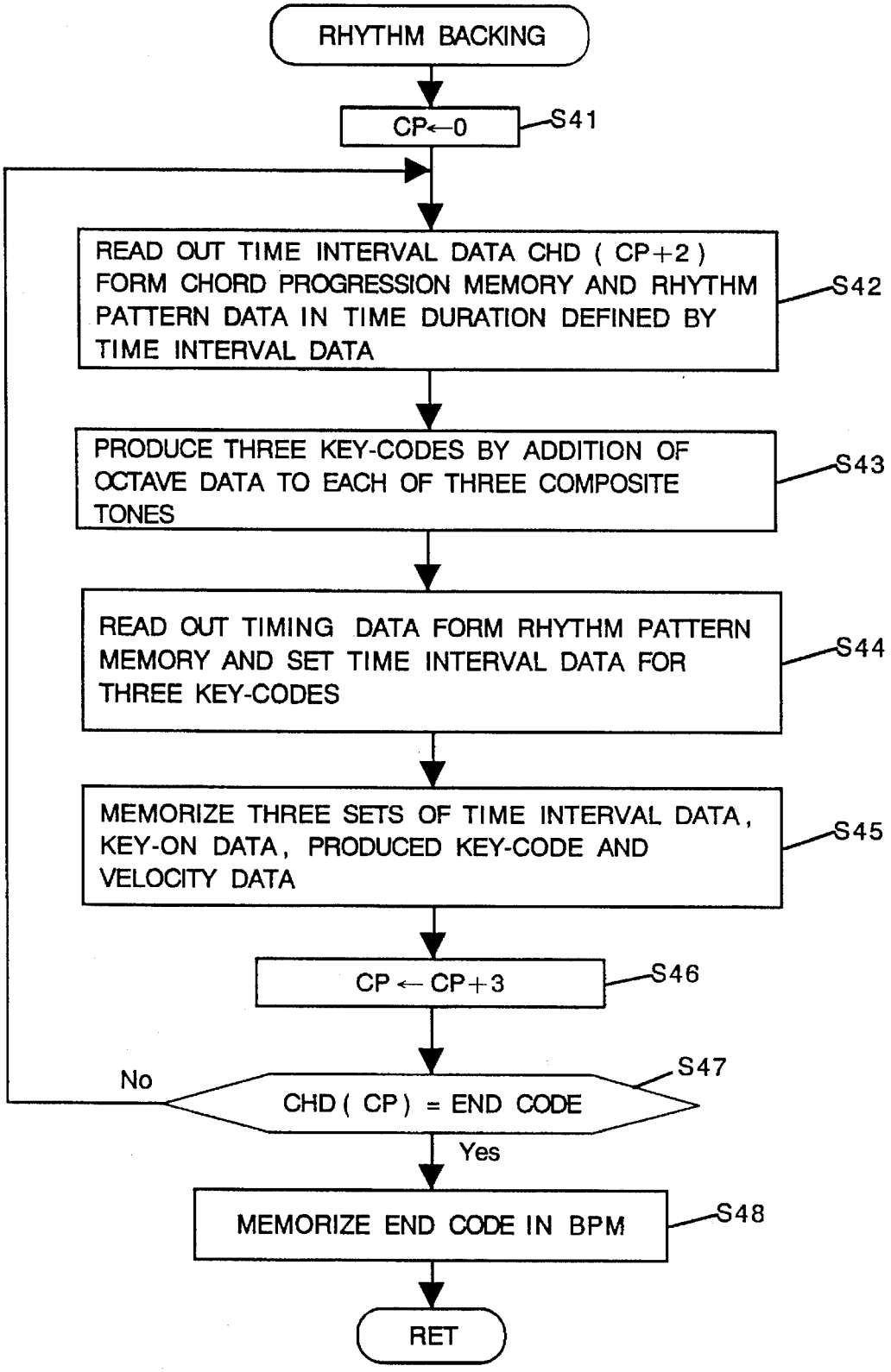
FIG. 10 is a flow chart of a rhythm backing routine of the control program.

During execution of the rhythm backing routine shown in FIG. 10, the CPU 1 resets at step S41 the pointer CP of the chord progression memory 6 and causes the program to proceeds to step S42 where the CPU I refers to the rhythm pattern corresponding with the performance style in the rhythm pattern memory 12 to read out a time interval data CHD(CP+ 2) allotted with a chord indicative of the chord root data CHD(CP) and the chord type data CHD(CP+ 1) from the chord progression memory 6 and reads out a rhythm pattern data in a time duration defined by the time interval data. At the following step S43, the CPU 1 produces three key-codes by addition of a predetermined octave data to each of the three composition tones of the chord. When the program proceeds to step S44, the CPU 1 reads out the timing data from the rhythm pattern memory 12 and sets the timing data as time interval data for the three key codes. Thus, the CPU I memorizes at step S45 three sets of the time interval data the key-on data, the produced key-code and the velocity data corresponding with the performance loudness of the arrangement condition in the backing part memory 8. Thereafter, the CPU 1 adds "3" to the pointer CP of chord progression memory 5 at step S46.

When the program proceeds to step S47, the CPU 1 determines whether the data of register CHD(CP) is an end code or not. If the answer at step S47 is "No", the CPU 1 returns the program to step S42 for processing of the following chord. If the data of register CHD(CP) is the end code the CPU 1 determines a "Yes" answer at step S47 and causes the program to proceed to step S48 where the CPU 1 memorizes the end code in the backing part memory 8 and returns the program to the main routine.

From the foregoing description, It will be understood that different performance data is produced by processing of the non-rhythm backing routine and the rhythm backing routine. During processing of the non-rhythm backing routine, continuous performance data is produced with one note until the code of the chord progression is changed. For instance, if the chord progression is arranged to provide one chord in one measure, performance data for the whole note will be produced. In the case that the chord changes in the chord progression at each half-measure in 4/4 beats, performance data for a half note is produced. Accordingly, the processing of the non-rhythm backing routine is effective to produce performance data optimal for expressing a melodic feeling in such a manner that a melodious melody is assisted by the chord.

During processing of the rhythm backing routine, a rhythm pattern suitable for expression of optimal rhythm timing is adapted at each performance style to select tone pitch in compliance with the chord progression and the melody. Accordingly, the processing of the rhythm backing routine is effective to produce performance data suitable for amplifying a rhythmic feeling or mood at each performance style.

What is claimed is:

1. An automatic arrangement apparatus, comprising:

first input means for applying performance data of a basic performance part for arrangement to a musical tune to be arranged;

second input means for applying arrangement condition data indicative of a desired performance for arrangement to the musical tune, wherein the arrangement condition data includes at least one of performance style data, loudness of musical tone data and musical feeling data;

first performance data production means for producing first performance data with an algorithm suitable for expression of a desired rhythmic feeling based on the performance data of the basic performance part;

second performance data production means for producing second performance data with an algorithm suitable for expression of a non-rhythmic feeling different from the rhythmic feeling based on the performance data of the basic performance parts; and selection means for selecting either said first or second performance data in accordance with the arrangement condition data as selected performance data of a performance backing part.

2. An automatic arrangement apparatus as claimed in claim 1, further comprising tone generation means for producing tones indicative of the performance backing part of the selected performance data.

3. An automatic arrangement apparatus as claimed in claim 1, wherein the selection means comprises a backing type table memory.

4. An automatic arrangement apparatus as claimed in claim 1, wherein the performance data of the basic performance part includes melody data and chord progression data.

5. An automatic arrangement apparatus as claimed in claim 1, further comprising bass part production means for producing a performance bass part based on the performance data of the basic performance part.

6. An automatic arrangement apparatus as claimed in claim 5, further comprising tone generation means for producing tones indicative of the performance backing part of the selected performance data and the performance bass part.

7. An automatic arrangement apparatus as claimed in claim wherein the first performance data production means includes rhythm pattern memory.

8. An automatic arrangement apparatus as claimed in claim 7, wherein the rhythm pattern memory stores data corresponding to a plurality of rhythm patterns, and wherein each rhythm pattern corresponds to a performance style.

* * * * *